US009187799B2

(12) United States Patent
Wilson et al.

(10) Patent No.: US 9,187,799 B2
(45) Date of Patent: Nov. 17, 2015

(54) 20 BAR SUPER QUENCH VACUUM FURNACE

(75) Inventors: Robert J. Wilson, Warrington, PA (US); Robert F. Daley, Jim Thorpe, PA (US)

(73) Assignee: William R. Jones, Telford, PA (US)

( * ) Notice: Subject to any disclaimer, the term of this patent is extended or adjusted under 35 U.S.C. 154(b) by 455 days.

(21) Appl. No.: 13/573,001

(22) Filed: Aug. 13, 2012

(65) Prior Publication Data

US 2014/0042678 A1 Feb. 13, 2014

(51) Int. Cl.
*C21D 1/773* (2006.01)
*C21D 9/00* (2006.01)

(52) U.S. Cl.
CPC ..... *C21D 9/0043* (2013.01); *C21D 1/773* (2013.01); *C21D 9/0062* (2013.01)

(58) Field of Classification Search
CPC ..... C21D 1/767; C21D 9/0043; C21D 1/06; C21D 1/773; C21D 9/0062; F27B 5/16; F27B 2005/162; F27B 2005/167; F27D 7/04
USPC ..... 266/205, 249–264; 432/247, 249, 250, 432/200–208
See application file for complete search history.

(56) References Cited

U.S. PATENT DOCUMENTS

| | | | | | |
|---|---|---|---|---|---|
| 3,364,654 | A | * | 1/1968 | Westbrock | 95/116 |
| 4,462,577 | A | * | 7/1984 | Westeren | 266/250 |
| 4,836,776 | A | | 6/1989 | Jomain | |
| 4,906,182 | A | | 3/1990 | Moller | |
| H777 | H | | 5/1990 | Natarajan | |
| 4,976,111 | A | * | 12/1990 | Larin | 62/55.5 |
| 5,267,257 | A | | 11/1993 | Jhawar et al. | |
| 5,478,985 | A | | 12/1995 | Hoetzl et al. | |
| 6,021,155 | A | | 2/2000 | Jones | |
| 6,023,155 | A | | 2/2000 | Kalinsky et al. | |
| 6,111,908 | A | | 8/2000 | Jones | |
| 6,903,306 | B2 | | 6/2005 | Moller | |
| 7,377,774 | B2 | | 5/2008 | Katsumata et al. | |
| 7,514,035 | B2 | * | 4/2009 | Jones | 266/250 |
| 7,547,410 | B2 | * | 6/2009 | Taniguchi | 266/259 |
| 8,088,328 | B2 | | 1/2012 | Jones | |
| 2006/0086442 | A1 | | 4/2006 | Taniguchi | |
| 2012/0060519 | A1 | * | 3/2012 | Tanaka | 62/55.5 |

FOREIGN PATENT DOCUMENTS

| | | |
|---|---|---|
| CN | 2683663 | 3/2005 |

* cited by examiner

*Primary Examiner* — Scott Kastler
*Assistant Examiner* — Michael Aboagye
(74) *Attorney, Agent, or Firm* — Aaron Nerenberg

(57) ABSTRACT

A vacuum furnace for heat treating and rapid gas quenching insitu a work piece at pressures up to 20 Bar and high gas velocities. The furnace comprises a single chamber having an inner portion including a plurality of graphite heating elements and graphite insulation, an outer portion and an access door. Further included are movable radiation baffle doors. In their closed position hot gases heat treat the work piece. In their open position the hot gases escape through the opening created onto chevron-shaped baffles in the outer portion which reflect radiation heat energy back into the inner portion and diffuse only convective heat energy into a heat exchanger and a variable speed drive recirculating fan. The recirculating fan directs the cooling gases through cooling nozzles onto the work piece to quench it to a pre-programmed temperature.

16 Claims, 4 Drawing Sheets

20 BAR SUPER QUENCH VACUUM FURNACE

BACKGROUND OF THE INVENTION

1. Field of the Invention

The present invention relates to a horizontal, single chamber front loading vacuum heat treating furnace capable of rapidly cooling the heat treated materials by insitu gas quenching at pressures up to 20 Bar and gas velocities approaching 200 miles/hour in a single chamber of the furnace.

2. Description of the Prior Art

The need for "green" environmentally friendly quenching capabilities has challenged furnace engineers to design furnaces capable of achieving high pressure, rapid gas quenching up to 20 Bar or greater. The ability to achieve such high gas pressures for cooling is driven by the need to eliminate the use of oil quenching for cooling of tool steels. Oil quenching is currently the fastest quenching medium for heat treatment of tool steels. However, it is rife with disadvantages, such as cracking and distortion due to high residual stress on the processed material. Some tool steel grades with reasonable cross-sections have been successfully quenched in a 10 Bar vacuum furnace, but there are limitations of the load size and part dimensions which need to be overcome. The use of 10 Bar quenching for lower alloy tool steels is limited. See, for example, U.S. Pat. No. 7,514,035. The present inability to gas quench such alloys led to the design and development of the present invention, which can achieve cooling gas pressures as high as 20 Bar and gas velocities approaching 200 miles/hour for rapid cooling of high and low alloy steels.

Typical high pressure gas quench multi-bar furnaces utilize a standard design of fixed thermal exit baffles and complicated fan cycling sequences—clockwise and counterclockwise—with directional control of the wind mass in order to achieve the necessary velocity within the furnace chamber in order to achieve the high pressures necessary to cool tool steels. See, for example, U.S. Pat. No. 5,478,985. Typical gas flow designs have stationary exit ports, which result in restricted gas flow and unacceptable pressure drops.

The use of movable baffles or bungs has been utilized previously in vacuum heat treat furnaces (see U.S. Pat. Nos. 6,903,306 and 8,088,328). However, the movable dampers in U.S. Pat. No. 6,903,306 are connected to a rigid fixed-size opening that is connected to one side of a narrow plenum. The bungs from U.S. Pat. No. 8,088,328 have a large plenumless gas chamber; however the gas must flow through a gas duct in order to pass through an external heat exchanger. These passageways result in high pressure drops, which are fine for an atmosphere quench design, but detrimental for quench pressures up to 20 Bar. The present design eliminates these limitations and therefore does not suffer from the gas flow restrictions and pressure drops of prior art designs.

Prior art references—U.S. Pat. Nos. 4,836,776, 4,906,182 and 5,478,985—teach improved gas flow, but the fixed gas baffle designs in these references suffer from high pressure drops leading to decreased energy transfer and longer cooling times and slower cooling rates. The configuration in U.S. Pat. No. 4,836,776 includes a movable baffle which feeds the hot gas from the furnace toward the heat exchanger and fan in a lateral direction, resulting in a higher pressure drop. The use of bearing assemblies in these baffle designs will eventually lead to mechanical failure, resulting in increased maintenance downtime and loss of service time for the furnace. These designs also suffer from direct flow of hot gases from the furnace into the center of a water-cooled heat exchanger and recirculation fan. Although the teaching in U.S. Pat. No. 7,514,035—that the fixed baffle design with gas recirculation systems and mammoth ducts helps prevent pressure drops—this design has its limitations, as much higher gas pressures (greater than 10 Bar) are utilized. In order to achieve cooling gas pressures up to 20 Bar without loss of cooling gas velocity due to high pressure drops, a new design for flow of hot gas to the heat exchanger and recirculation fan was required. The present design is an improvement over the teachings in U.S. Pat. No. 7,514,035 and in the other prior art references mentioned above.

The design and teachings of the present invention result in the ability to achieve high pressure quenching up to 20 Bar with gas cooling velocities approaching 200 miles/hour, thereby rapidly cooling the work piece by diffusing the gas through a much larger opening directly into the heat exchanger and the blower fan and returning the cooled gas into a large gas chamber insitu. Accordingly, pressure drops associated with typical gas quench furnaces have been eliminated. A key feature of the present design is the movable doors which provide a dual purpose. When the doors are closed during the heating cycle, they provide a mechanism for retaining temperature uniformity during the heating cycle throughout the hot zone, and they serve to prevent thermal radiation from leaking around the baffles, such as in the stationary baffle designs of the prior art.

Similar techniques have been utilized in prior art designs, such as in U.S. Pat. No. 8,088,328, which discloses an atmosphere furnace that is not designed for high pressure gas quenching. The present design has the opening at the rearward end of the furnace directly attached to a heat exchanger with a more compact design that incorporates a high surface area per unit volume. Another key feature of the present invention is the coupling of this large opening with a specially designed chevron-type baffle made of stainless steel. The chevron baffle is situated behind the movable radiation shield doors and is not exposed to the heat from the heating cycle until the gas quenching cycle is initiated. The purpose of the chevron baffle is two-fold. One purpose is to serve as a gas diffuser, and the other is to serve as a radiation barrier of the radiant heat from the furnace hot zone to the heat exchanger at the beginning of the quenching cycle. The heat exchanger will only be exposed to convective heat from the recirculation of the cooling gases.

SUMMARY OF THE INVENTION

This invention is related to a single chamber vacuum heat treating furnace in which a work piece is heat treated and gas quenched in the same chamber, wherein the gas quenching is achieved using an improved apparatus which results in enhanced heat transfer between the heated work piece and the quenching gas.

In one of its aspects this invention provides a vacuum furnace for heat treating and rapid gas quenching a work piece in the same furnace, comprising a single chamber and access means, and further comprising heat exchanger means and blower means, the chamber being segregated into an outer portion and an inner portion, with the inner portion being adapted to receive the work piece to be heat treated through the access means and further including movable doors that are closed to seal in the hot gases during the heating cycle and opened during the quenching cycle to allow the hot gases to pass through from the furnace hot zone, the furnace further including baffle means juxtaposed from the movable doors whereby the hot gases can pass through the opening created by the open doors and through the baffle means to diffuse the hot gases before reaching the heat exchanger means and blower means, and the baffle means further serving as a radiation barrier between the inner portion hot zone and the heat exchanger means.

DETAILED DESCRIPTION OF THE INVENTION

Figure 1:
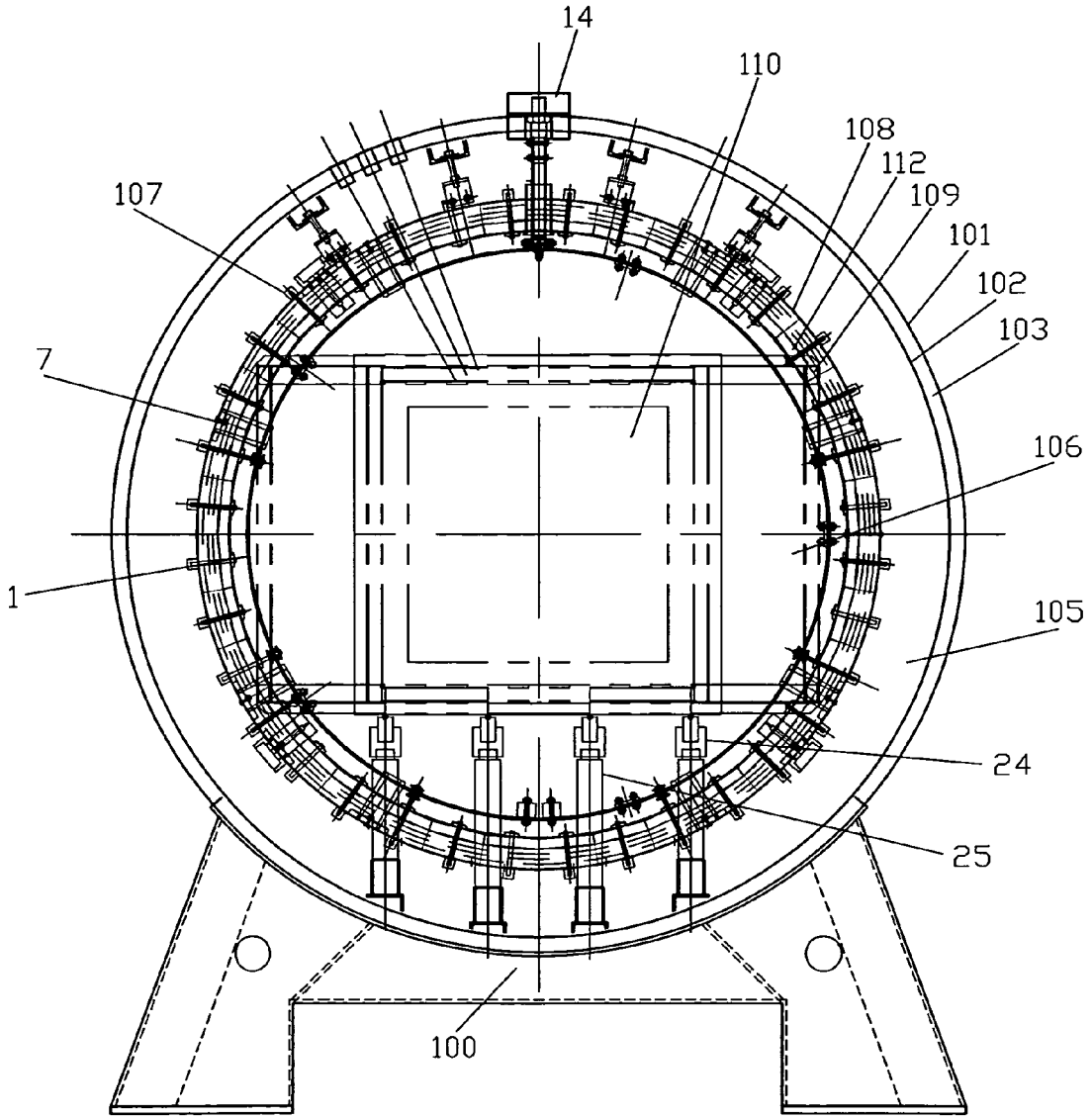
FIG. 1 depicts in perspective a partial front, open door cross-section view of a high temperature vacuum-high pressure quench heat treating furnace 100.

Referring to the drawings wherein like reference numerals refer to the same or similar elements across the multiple views, FIG. 1 depicts a partial front open door cross-section view (looking toward the door end) of a high temperature vacuum-high pressure quench heat treating furnace 100. Furnace 100 includes a hinged door 150 (shown in FIG. 2) which is opened to allow the insertion of a work piece to be heat treated, and then closed during the heat treating cycle. Outer furnace wall 101 and inner wall 102 of furnace 100 form the radial boundaries of a furnace water jacket 103 used for cooling outer wall 101 of the furnace. The outer chamber of furnace 100 thus is a cylindrical double walled, water-cooled vessel, and is typically manufactured from low carbon steel. All flanges are similarly machined. The width of water jacket 103 is approximately 1 inch maximum, with large oversized water inlet and exit ports (not shown) located around the chamber to allow for convenient periodic flushing of the water jacket to reduce sediment build-up. Inner wall 102 also forms the outer wall of a spacious gas plenum chamber 105, which is a large annular cavity that is important to high velocity (very rapid) quenching.

The inner wall of gas chamber 105 forms a hot zone 106 of vacuum furnace 100. Hot zone 106 includes a work zone 110 for heat treating a work piece placed in the furnace. It should be understood that the term work piece can refer to a single piece or multiple pieces to be heat treated and rapidly as quenched. Work zone 110 generally consists of a graphite hearth which includes graphite rails 24 and graphite support pins 25. Work zone sizes typically range from 18 inches high by 24 inches deep, allowing for large work pieces to be treated at high temperature to relatively and predictably precise tolerances±10° F. It should be understood that the dimensions of the hot zone could be advantageously varied and still remain in keeping with the spirit and scope of the present invention. Cylindrically shaped resistance heating elements 1, desirably made of graphite, each form a complete circle and are supported in place by molybdenum standoff assemblies 107 (as described in U.S. Pat. Nos. 6,111,908, 6,021,155 and 6,023,155).

The hot zone ring assembly includes an outer layer of 0.38 mm (0.015 inch) graphite foil 108, at least three layers of 0.5 in of graphite felt insulation 109, and an inner insulation layer comprised of durable 1.0 inch graphite board 112. Insulation 109 is desirably of low mass insulation material comprising 1.0 inch highly durable graphite board 112 having graphite foil bonded thereto onto the board side facing the heating elements 1, which is further backed by at least three layers of 0.5 inch high purity graphite felt and a heat-reflecting graphite foil (not shown) approximately 0.38 mm thick (0.015 inches) all attached to the inner wall of foil 108. Graphite board 112 is necessary when using very high pressures up to 20 Bar in order to prevent deterioration of the insulating material from such high pressures and impingement from the high velocity cooling gases. Heating elements 1 are connected to water-cooled power terminal assemblies 14. The vacuum furnace system is designed to operate in conjunction with a vacuum capable of reaching a vacuum range of about $10^{-4}$ Torr, and at least one high pressure system (including, for example, a surge tank) for achieving a high pressure of at least 20 Bar in the furnace.

Figure 2:
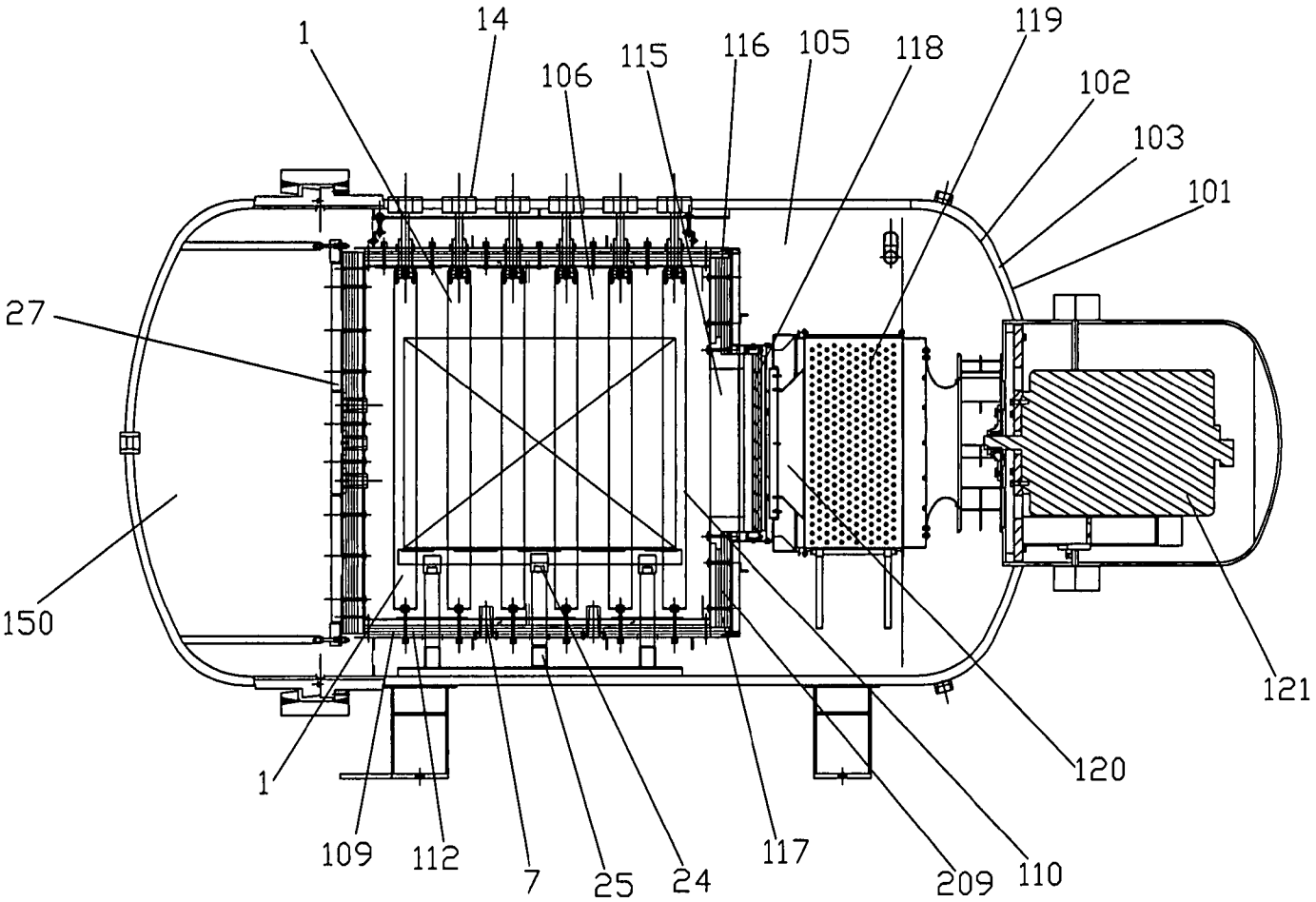
FIG. 2 depicts in perspective a side horizontal, closed door cross-section view of a high temperature vacuum-high pressure quench heat treating furnace 100.

Referring to FIG. 2, at the rear end of hot zone 106 is a circular wall (not shown) which comprises an opening 115 containing movable radiation baffle doors 116 and 117, preferably made from stainless steel. When doors 116 and 117 are opened, expose multiple chevron baffles 118 are exposed to direct gases from hot work zone 110 outward into a water-cooled, copper finned heat exchanger 119, and thereafter to a 300 to 400 horsepower variable speed drive recirculation fan 121. The chevron baffles 118 are also preferably made from stainless steel. It should be understood that other materials could be used for the doors and the chevron baffles while still remaining within the spirit and scope of the present invention. The chevron baffles 118 serve two purposes. The first purpose is to act as a radiation barrier between the hot work zone 110 and the heat exchanger 119. Upon opening the radiation baffle doors 116 and 117, all radiant energy from the heated work zone would otherwise transfer immediately into and overwhelm the heat exchanger 119, leading to its rapid failure. The chevron baffles 118 serve to deflect radiation energy back into the hot work zone 110 in a similar fashion as a metal heat shield in a typical all metal hot zone, which reflects radiant heat back towards the work piece during a heating cycle, and also serves to avoid heat losses during the heating cycle. This leaves only convective heat energy via the hot gases as the source of heat that must be removed by the heat exchanger 119. Reducing the effects of any source of radiant heat energy decreases the heat load placed on the heat exchanger during the quenching cycle, thus minimizing various maintenance issues typically required for heat exchangers that deal with both radiation and convection heat loads.

Figure 3:
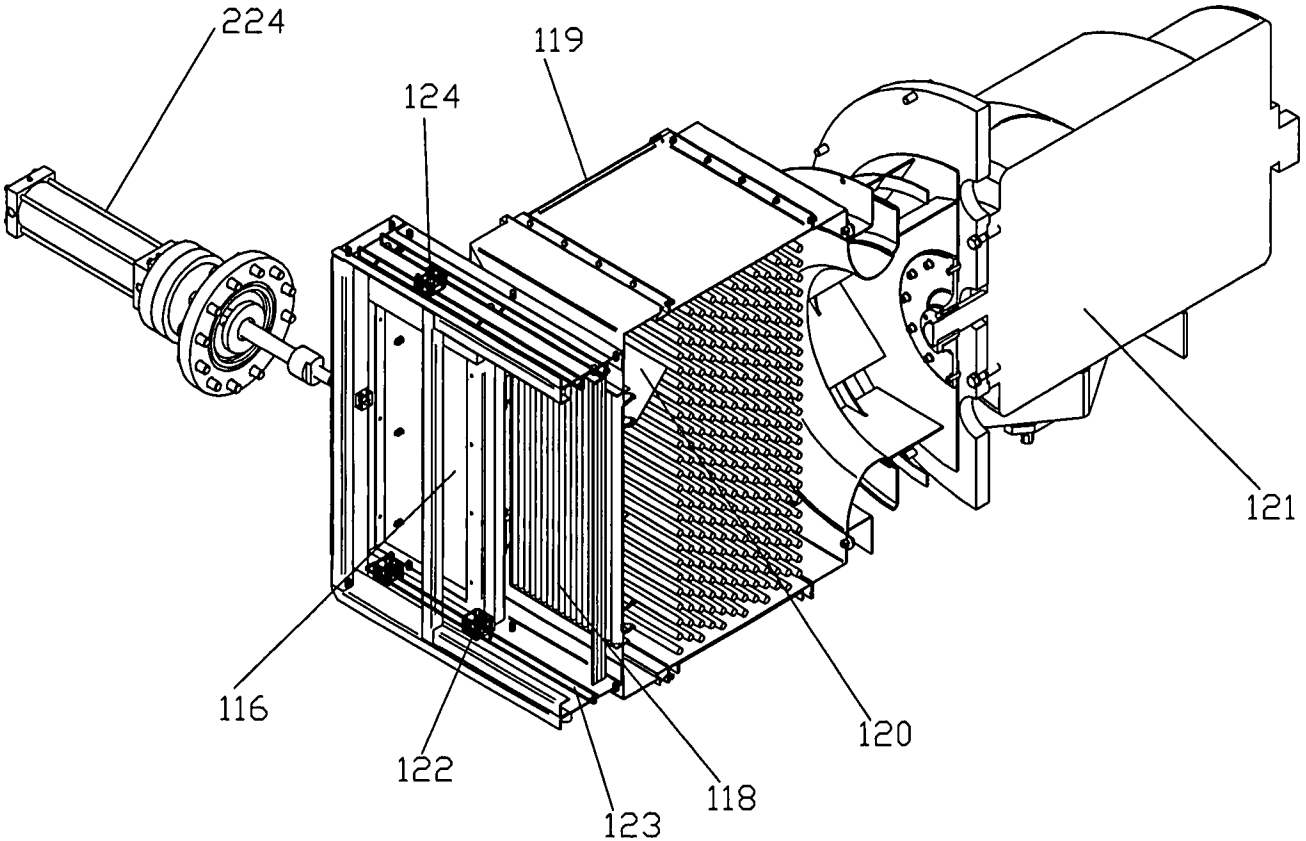
FIG. 3 depicts a perspective partial side view of the rear end of heat treating furnace 100 showing the movable doors, chevron baffles, heat exchanger and blower assembly.

As shown in FIG. 3, a second diffuser 120 serves in conjunction with chevron baffles 118 as a gas diffuser to ensure that the hot gases are distributed evenly over the face of heat exchanger 119. The use of both baffles 118 and diffuser 120 allows the cooling gases, which have picked up heat through convection heat transfer from the hot work piece, to pass through the opening 115 created by opening the movable radiation baffle doors 116 and 117 to the copper fumed heat exchanger 119 in a diffuse pattern in order not to overwhelm the center of the heat exchanger. The distribution of the hot gases over the full surface area of the heat exchanger, as well as the promotion of turbulence at the inlet of heat exchanger 119, allows for efficient heat transfer between the hot gas and the heat exchanger 119, providing rapid and more efficient cooling of the quenching gas before it is transferred back to the recirculating fan 121 and then into gas chamber 105 through gas nozzles 7 (shown in FIGS. 1 and 2) into the hot zone 110.

A further unique feature of the present invention, as described and shown in furnace 100 in FIGS. 1 and 2, is the design of the movable radiation baffle doors 116 and 117. Doors 116 and 117 are equipped with hardened H-13 rollers 122 that sit on and roll on a hardened H-13 track 123, shown in FIGS. 3 and 4. Rollers 122 and track 123 work in concert with each other, and have been hardened to different specifications for better wear resistance and to avoid galling, as the doors are opened and closed during the heating and quenching cycles. Track 123 is preferably hardened to approximately Rockwell C 40-50 but may be hardened to as high as Rockwell C 60, while rollers 122 are preferably hardened to approximately Rockwell C 42-45 (but not to the same hardness as track 123). These differentially hardened parts are designed to prevent maintenance issues during frequent repetitive use of the furnace.

Figure 4:
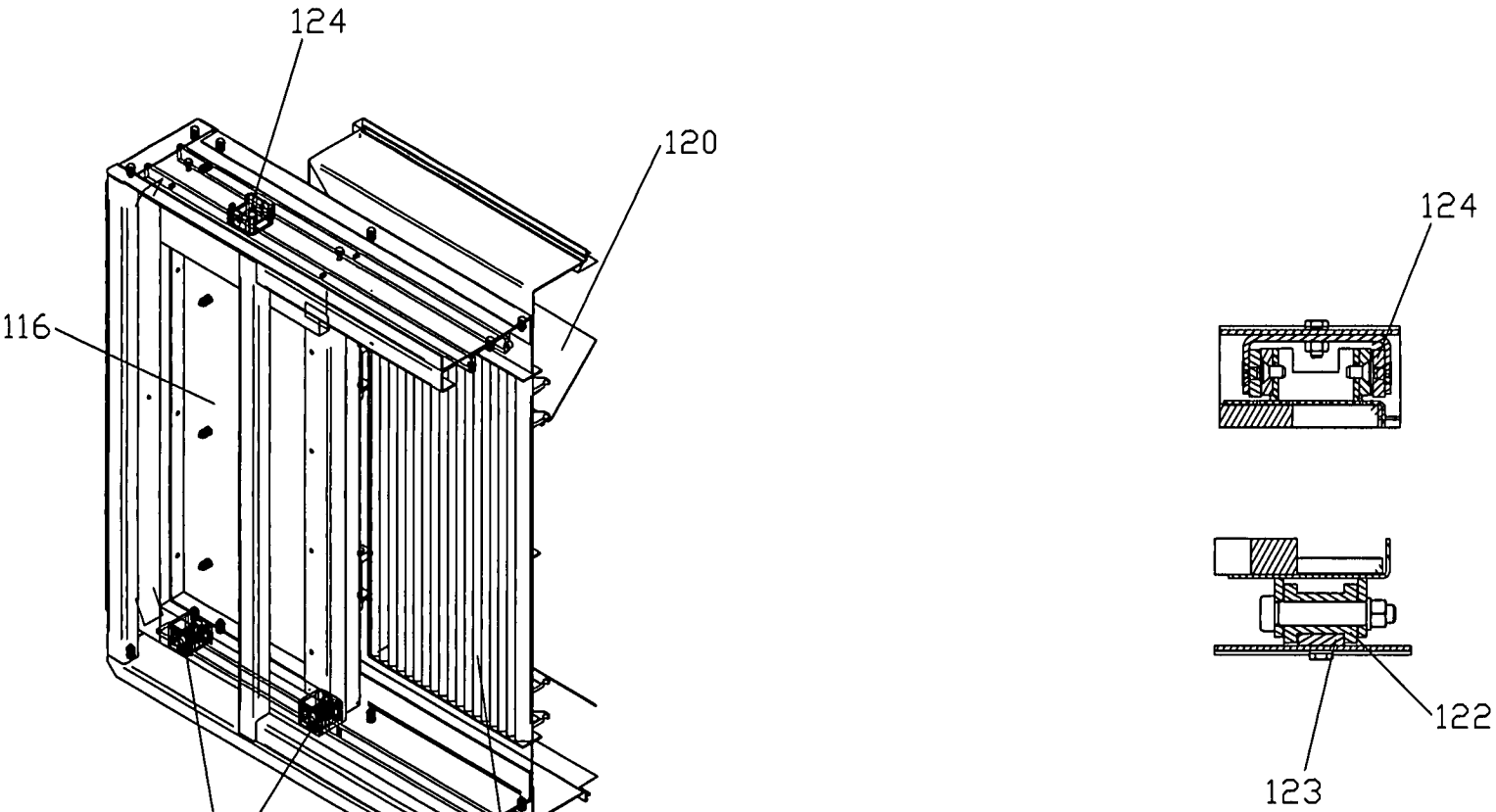
FIG. 4 depicts a perspective partial cutaway view revealing features of the movable doors, rollers, guides, tracks, and chevron baffles of furnace 100.

A major improvement over prior art vacuum furnaces, according to the present invention, is the minimal interruption of flow of cooling gas through the heat exchanger 119 to the recirculating fan 121 and back into the spacious plenum 105, and further back into the hot work zone 110 via cooling nozzles 7. The movable radiation baffle doors 116 and 117 contain an insulation package (not shown) comprising the same material as shown in FIG. 1 and described for hot zone 106, consisting of graphite foil, graphite felt and graphite board. As shown in FIGS. 3 and 4, the radiation baffle doors 116 and 117 (not shown) are mounted on hardened steel roller wheels 122 which fit in a hardened H-13 channel guide 124 above the doors. The door mechanisms are operated via pneumatic actuators 224 and 225 (not shown). When the work piece is being heated in hot zone 110, radiation baffle doors 116 and 117 are set in the closed position. This provides a tight seal during the heating cycle and allows for improved temperature uniformity throughout the hot zone. After the heating cycle has been completed, the doors are opened and the cooling gas is introduced via cooling gas nozzles 7, which are evenly distributed around the hot work zone 110. Cooling gas nozzles 7 have been previously described in U.S. Pat. No. 7,514,035, the description of which is incorporated herein by reference. Additional cooling gas nozzles 27 are located in the interior of the furnace door 150, as shown in FIG. 2 and previously described in U.S. Pat. No. 7,514,035. The location of cooling gas nozzles 27 in the furnace door provides additional flow uniformity from the furnace front door to the rearward exit port when radiation baffle doors 116 and 117 are opened. When the cooling gas passes through gas chamber 105 by means of recirculation fan 121, some of the gas passes from gas chamber 105 to the furnace front door 150 and back to the hot work zone 110 via cooling gas nozzles 27. The high velocity cooling gas passes uniformly around the work piece, transferring heat from the work piece to the cooling gas. The gas is drawn into the open radiation port 115, through the chevron baffles 118 and diffuser 120, and into the water-cooled, copper finned heat exchanger 119. The heat exchanger has a very compact design which incorporates a high surface area to unit volume for more efficient heat transfer and increased cooling rate of the recycled gas. This allows for direct exit of the cooling gas and return to the cooling gas nozzles 7 and 27 without any stationary fixed radiation baffle restrictions or return duct systems, both of which introduce pressure drops, such as in the prior art teachings in U.S. Pat. Nos. 5,267,257 and 7,514,035.

The recirculating gas flow is driven by a 300 to 400 horsepower, high performance, easily accessible rear mounted, variable drive 230 volt motor recirculating fan 121. The use of a specialty constant horsepower variable speed driven fan in the present invention allows the furnace to maintain constant horsepower whether the quench pressure is running anywhere from less than 2 Bar to 20 Bar. The recirculating fan blower motor, although rated for 1800 RPM, can be run in constant horsepower between 1800 and 3600 RPM. This feature therefore allows for variable quench pressures without loss of gas mass flow according to the following equation explained by the fan laws below:

$$\text{Horsepower}=\text{Pressure}\times\text{Speed(RPM)}$$

The following fan laws allow relationships to be shown between various measurable changes in the variable speed drive motor as it relates to quench pressure. The four equations that allow such a relationship are as follows:

$$G=K_q ND^3 \quad (1)$$

$$m=K_m \rho ND^3 \quad (2)$$

$$P=K_p \rho N^2 D^3 \quad (3)$$

$$HP=K_p \rho N^3 D^5 \quad (4)$$

Where:

G=volumetric flowrate; m=mass flow; N=fan speed (RPM);

D=fan diameter; HP=power output; ρ=air density; P=gas pressure;

all K values are constants

By substituting equation (3) into equation (4) above, a relationship between pressure, speed and horsepower can be determined, as in equation (5) as follows:

$$HP=PND^2 \quad (5)$$

With a variable speed drive motor the fan diameter remains constant, which can simplify the relationship into equation (6) as follows:

$$HP=PN \quad (6)$$

Therefore, when running in a constant horsepower range of the fan motor—at or above the rated 1800 RPM motor speed in the present invention—any increase or decrease in quench pressure requires an adjustment of the motor speed. The use of a specially designed 1800 RPM motor which can be variably adjusted to perform at speeds between 1800 RPM and 3600 RPM without failure provides the means to achieve efficient and fast cooling at quench pressures less than or equal to 20 Bar.

In accordance with the present invention a number of gases may be used to quench the work piece, including but not limited to nitrogen, hydrogen, argon and helium. These gases may also be blended together in various combinations in accordance with different operation requirements. The use of a variable speed drive allows the use of gases of different densities without the loss of desired quenching pressures.

In some heat treating processes very high pressures of up to 20 Bar may not be advisable. With a constant horsepower recirculating fan arrangement the use of lower pressures less than 20 Bar is offset by running at much higher speeds—greater than 1800 RPM up to 3600 RPM. Thus there is a higher mass flow through nozzles 7 and 27 in order to provide the necessary quench rates without the need for such high pressures. The increased mass flow results in increased gas velocity, which offsets the decrease in gas density at the lower pressures. Conversely, when running at higher pressures up to 20 Bar, the gas density increases and therefore the mass flow decreases, requiring the lower motor speed down to 1800 RPM. The quench efficiency is increased relative to the increased pressure, which offsets the decreased speed of the motor. This additional advantage of the present invention provides a multipurpose vacuum heat treating furnace capable of using a wide range of quenching pressures.

While there has been described what is believed to be a preferred embodiment of the present invention, those skilled in the art will recognize that other and further modifications may be made thereto without departing from the spirit and scope of the invention. It is therefore intended to claim all such embodiments that fall within the true scope of the invention.

What is claimed is:

1. A vacuum furnace operating in excess of 10 Bar pressure for heat treating and rapid gas quenching a work piece in the same furnace comprising a single chamber and access means, said chamber being segregated into an outer portion and an inner portion, said inner portion of said chamber being a hot zone and being adapted to receive the work piece to be heat treated through said access means, the furnace further comprising movable door means in said chamber outer portion in the form of movable doors formed to be closed during the heat treating cycle and opened during a quenching cycle, the furnace chamber outer portion further comprising heat exchanger means, blower means and baffle means in the form of a chevron configuration formed to deflect the radiant energy of the hot zone passing into said outer portion of said chamber through an opening created by said movable doors being in the open position back through the opening into said inner portion hot zone of said chamber, and wherein said chevron configuration baffle means is further formed to diffuse the convective heat energy of the hot gases passing through said opening and to distribute said convective heat energy evenly over the full surface area of said heat exchanger means during the quenching cycle, said chevron configuration baffle means being located in said outer portion of said chamber juxtaposed from said movable doors, and wherein said heat exchanger means being located in proximity to said chevron configuration baffle means and said blower means, and said blower means being located in proximity to said heat exchanger means for circulating gases into said inner portion hot zone of said chamber to quench the work piece.

2. A vacuum heat treating furnace in accordance with claim 1 wherein said movable doors are in a closed position to seal in the radiant heat in said inner portion hot zone of said chamber during the heat treating cycle, and said movable doors are in an open position to allow hot gases from said inner portion of said chamber to pass through into said outer portion of said chamber into said chevron configuration baffle means and through said chevron configuration baffle means into said heat exchanger means during the quenching cycle.

3. A vacuum heat treating furnace in accordance with claim 1 wherein said heat exchanger means is formed to cool the convective gases from said chevron configuration baffle means and pass the cooled gases to said blower means, said blower means being formed to recirculate the cooled gases into said inner portion hot zone of said chamber to quench the work piece.

4. A vacuum heat treating furnace in accordance with claim 3 wherein the furnace further includes nozzle means adjacent said inner portion hot zone of said chamber for receiving the cooled gases from said blower means and directing the cooled gases to the work piece.

5. A vacuum heat treating furnace in accordance with claim 1 further comprising diffuser means in proximity to said chevron configuration baffle means and said heat exchanger means for further diffusing the convective hot gases passing through said opening and distributing the convective heat energy evenly over the full surface area of said heat exchanger means.

6. A vacuum heat treating furnace in accordance with claim 1 wherein the furnace further includes roller means and track means, and wherein said movable door means are operably connected to said roller means and said track means.

7. A vacuum heat treating furnace in accordance with claim 6 wherein the furnace further includes guide means, and wherein said roller means are operably connected to said guide means.

8. A vacuum heat treating furnace in accordance with claim 6 wherein said roller means comprise hardened steel rollers and said track means comprise a hardened steel track, said hardened steel rollers being formed to operably move on said hardened steel track.

9. A vacuum heat treating furnace in accordance with claim 8 wherein said hardened steel rollers and said hardened steel track are each hardened to different hardness values.

10. A vacuum heat treating furnace in accordance with claim 9 wherein said hardened steel rollers and said hardened steel track are differentially hardened to a range of approximately Rockwell C 40 to Rockwell C 60 hardness.

11. A vacuum heat treating furnace in accordance with claim 9 wherein said hardened steel rollers are hardened to approximately Rockwell C 40 to C 50, and said hardened steel track is hardened to approximately Rockwell C 42 to C 45.

12. A vacuum heat treating furnace in accordance with claim 1 wherein said blower means is driven by a constant horsepower variable speed motor blower fan.

13. A vacuum heat treating furnace in accordance with claim 12 wherein said motor blower fan is formed to run at constant horsepower in the range of approximately 1800 RPM to approximately 3600 RPM.

14. A vacuum heat treating furnace in accordance with claim 1 wherein the quench pressure of the cooling gases recirculated by said motor blower fan is formed to operate from more than approximately 10 Bar to approximately 20 Bar.

15. A vacuum heat treating furnace in accordance with claim 1 wherein the velocity of the cooling gases recirculated by said motor blower fan is formed to reach approximately 200 miles per hour.

16. A vacuum heat treating furnace in accordance with claim 4 wherein the cooled gases from said blower means cool the work piece in said inner portion hot zone of said chamber to a desired pre-programmed temperature.

* * * * *